United States Patent [19]

Egli

[11] 4,373,317

[45] Feb. 15, 1983

[54] CONTAINER WITH LID

[75] Inventor: Alwin Egli, Beringen, Switzerland

[73] Assignee: Platmanufaktur AB, Malmo, Sweden

[21] Appl. No.: 155,403

[22] Filed: Jun. 2, 1980

Related U.S. Application Data

[62] Division of Ser. No. 970,339, Dec. 18, 1978.

[30] Foreign Application Priority Data

Jan. 2, 1978 [SE] Sweden ..... 7800006

[51] Int. Cl.[3] ..... B65B 61/18; B65B 7/28

[52] U.S. Cl. ..... 53/412; 53/420; 53/449; 53/478; 53/487; 53/489

[58] Field of Search ..... 53/412, 420, 449, 471, 53/478, 487, 488, 489, 491; 229/43, 44 R; 206/626

[56] References Cited

U.S. PATENT DOCUMENTS

| | | | |
|---|---|---|---|
| 1,058,929 | 4/1913 | Weiss | 229/44 R |
| 1,270,294 | 6/1918 | Hofman | 229/43 |
| 1,431,616 | 10/1922 | Wood | 229/44 R |
| 2,017,176 | 10/1935 | Andrews | 229/44 R |
| 2,218,509 | 10/1940 | Goodyear | 206/626 |
| 2,750,094 | 6/1956 | Magill | 53/449 X |
| 2,903,173 | 9/1959 | Hopkins | 229/44 R |
| 3,049,283 | 8/1962 | Buttery et al. | 229/43 |
| 3,206,907 | 9/1965 | Schroeder | 53/449 |
| 4,079,567 | 3/1978 | Spruyt et al. | 53/412 |
| 4,109,822 | 8/1978 | Egli | 229/44 R |

FOREIGN PATENT DOCUMENTS

| | | | |
|---|---|---|---|
| 700741 | 12/1953 | United Kingdom | 229/43 |

*Primary Examiner*—Horace M. Culver

*Attorney, Agent, or Firm*—Hane, Roberts, Spiecens & Cohen

[57] ABSTRACT

A method of manufacturing a container with a lid comprising folding a blank of material to form an inner lid element having a flat bottom and a frame along at least two sides of said bottom, placing the inner lid element into an open end of a filled container with the bottom of the inner lid element facing into the container, placing a blank of material for an outer lid element against the frame of the lid element and joining the outer lid element to the inner lid element.

14 Claims, 14 Drawing Figures

FIG. 1A
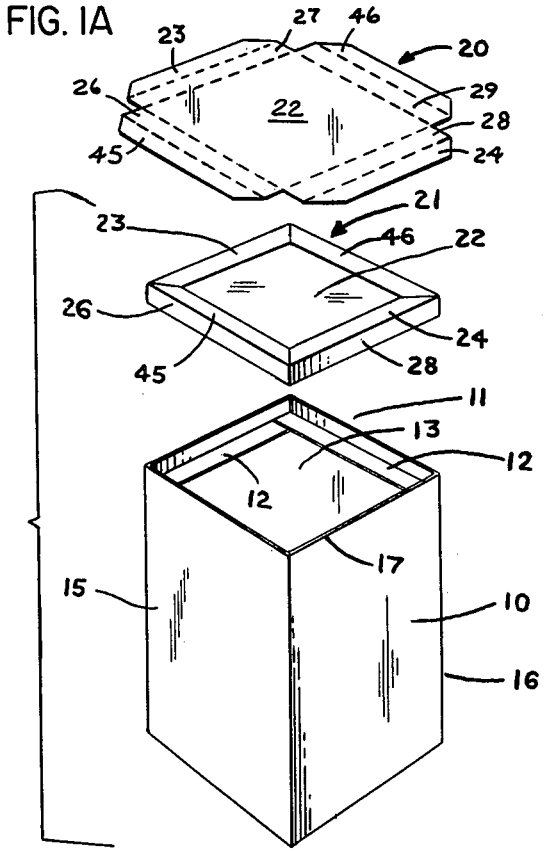
FIG. 1B
FIG. 2A
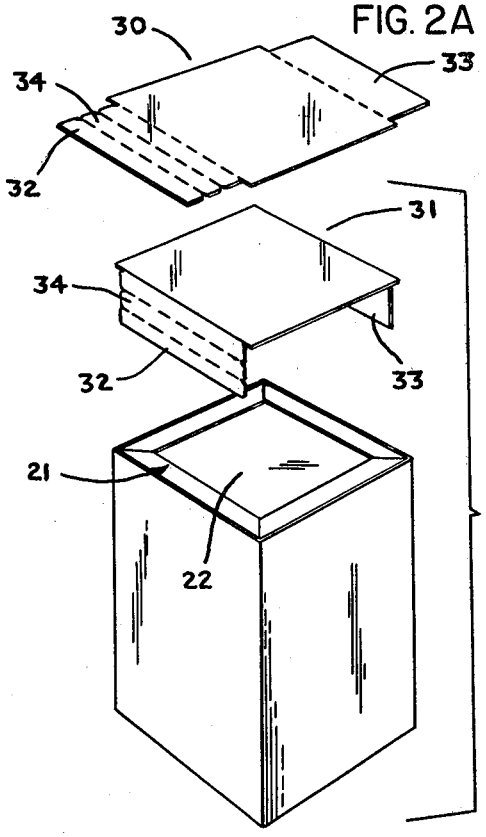
FIG. 2B
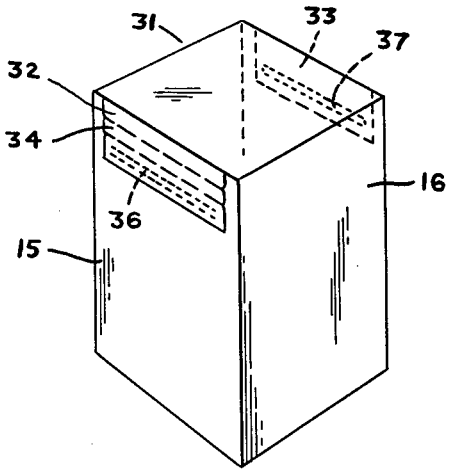
FIG. 3
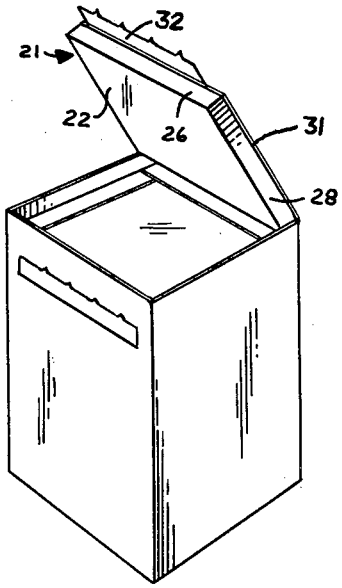
FIG. 4

CONTAINER WITH LID

This is a division, of application Ser. No. 970,339, filed Dec. 18, 1978.

FIELD OF THE INVENTION

The present invention relates to a method of making a container with a lid consisting of cardboard, carton, plastic or a similar stiff, foldable material, where the opening part of the container is arranged with an inwards directed peripheral flange and/or the container is arranged with a substantially plane limiting surface turned against the opening part of the container for example, making up an upper side of an inner package, and where the lid mainly consists of a material of the same type as the container. The lid is arranged to allow re-closing of an opened container.

PRIOR ART

In many different connections, for example, within the food industry, there is a requirement for packages which make it possible for the consumer to re-close an opened package. Such packages have been known for a long time. As an example of this can be mentioned tins made of metal plate combined with a lid made of metal plate or plastic. For economic reasons efforts are still made within the industry to reduce the costs of the packages without therefore reducing the requirements which the user of the packages has a right to make to these. As a replacement for tins made of metal plate have therefore come forward packages made of cardboard, primarily of a box-shaped appearance. If they are given sufficient mechanical strength such packages can be provided with an opening part which by and large makes up one of the sides of the package. Therefore it is very simple for the users of the contents of the package to empty this package of its contents in portions. Packages of such a type are known, for example, from the Swedish patent Nos. 7312683-1 and 7312684-9. The packages described in these patents are built up with an outer supporting cover and with an inside flexible container placed in this, which is made of a material which is adapted to the requirements made by the goods which are to be stored in the package. In the above patents there is even description of various variations of lid constructions adapted to the packages.

A drawback of the lid constructions mentioned in the above patents is that the function wanted is best obtained if the lid is made of plastic. On the other hand, it has turned out that the outer supporting cover acquires sufficiently good qualities if it is made of cardboard. From the point of view of production this fact entails that two completely different procedures of production will be required for the manufacture of the containers, i e a procedure based upon the technique which is applied for the manufacture of products made of plastic, and a procedure based upon the technique required in connection with the manufacture of products made of cardboard. This leads to the fact that two different types of machines will be required, and in addition to this both the maintenance staff and supervision staff must be trained to handle two methods of manufacture which are essentially different from each other. These things will, of course, lead to larger total costs than if only one type of material had to be used.

The above-mentioned drawbacks have sometimes been prevented by letting special producers manufacture the lids for stock and then the lids have been sent to manufacturers or users of the actual package. This means, of course, that large requirements are made as to the accuracy of the manufacture of the lids. This fact, in addition to the necessity of a stock, counteract to a certain extent the reduction in costs which can be obtained through the use of manufacturers who have specialized in the manufacture of plastic products.

SUMMARY OF THE INVENTION

The present invention removes the above-mentioned drawbacks as the invention contemplates to a method for the manufacture of a container, where the container and the lid can be made of the same type of material.

The lid consists of two parts, hereinafter referred to as the inner part of the lid and the outer part of the lid. The inner part of the lid is, in principle, made of a box-like construction with its bottom turned against the opening of the container. Two flanges directed against each other branch off from at least two opposite sides of the inner part of the lid. The flanges are substantially parallel with the bottom of the inner part of the lid. The inner part of the lid, which is thus formed, lies tightly against the inner surfaces of the opening part of the container and it is of a thickness and height which is adapted to the distance between the top limiting surface of goods filled into the container and the top limiting edges of the opening part of the container.

The outer part of the lid makes up a cover for the box-like construction which is formed by the inner part of the lid. The outer part of the lid is fixed against the inner part of the lid along the flanges of the inner part of the lid. The outer part of the lid is arranged with at least two flaps which can be folded down along two opposite sides of the container. These flaps are fixed against the container. In one of the flaps there is a tear-off strip, which is positioned between the fixation of the flap against the side of the container and the folding edge which forms the passage of the flap towards the part of the outer part of the lid which forms the cover of the inner part of the lid.

The box-like construction of the inner part of the lid with the flanges, which are substantially parallel with the bottom of the inner part of the lid, combined with the outer part of the lid, which is fixed against the flanges, gives the lid great mechanical strength and stability. One of the flaps of the outer part of the lid forms a hinge in connection with the opening and closing of the container, whereas the other flap makes it possible for a closed container to be opened easily by tearing off the earlier mentioned tearing-off strip.

To sum up the advantages of the invention, a container with lid according to the invention has the advantage that the same type of material is used for the container and the lid, stability in the lid construction, possibility of tightening reclosing, simplicity of opening and re-closing, and ability in the filled packages to be stacked.

BRIEF DESCRIPTION OF THE DRAWINGS

The invention will be described in further detail in connection with the figures of the attached drawings wherein:

FIG. 1A is a perspective view of a blank for forming an inner part of a lid of a container, FIG. 1B is an exploded view of the container and the inner part of the lid, FIG. 2A is a perspective view of a blank for forming an outer part of the lid of the container, FIG. 2B is an exploded view of the container with the inner part of the lid fitted therein and with the outer part of the lid separated therefrom, FIG. 3 shows a closed container, FIG. 4 shows an open container.

DETAILED DESCRIPTION

Figure 5A:
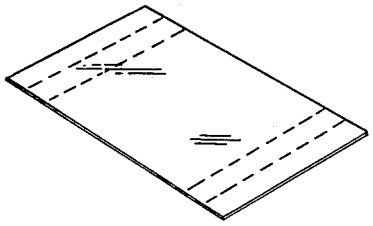
FIGS. 5–8 show a number of alternative embodiments of the inner part of the lid.

In FIG. 1B there is seen a container 10 with an opening part 11 arranged with an inwards directed peripheral flange 12. In the opening part is shown a limiting surface 13, which can form part of the outer package but even form one of the sides of an inner package placed in the container 10. Two opposite sides of the container are designated 15 and 16.

Just above the container 10 is an inner part 21 of the lid. The inner part 21 is formed from a blank 20 shown in FIG. 1A.

The material blank 20 is arranged with a number of folding lines so that four double flaps can be folded. When the folding has been finished the inner part of the lid comprises a bottom 22 and four sides 26–29, which are substantially upright at right angles to the bottom. These sides are integral with edge flanges 23, 24, 45, 46, which are mainly parallel with the bottom 22 and in the figure directed towards the center of the inner part of the lid. The inner part of the lid formed in this way is adapted to the dimensions of the opening part 11 of the container so that the sides 26–29 lie true against the inner limiting surfaces of the opening part and so that the height of the inner part of the lid is substantially in accordance with the distance between the limiting surface 13 of the opening part and the top edge 17 of the opening part.

In FIG. 2B the inner part 21 of the lid is situated in the opening part of the container. Above the container is shown an outer part 31 of the lid. The outer part 31 is formed from a blank 30 shown in FIG. 2A. The blank 30 has two opposite flaps 32, 33 separated from the central part of the material by means of folding lines. One of the flaps has a tear-off strip 34.

FIG. 3 shows a closed container where the outer part of the lid is found in its place above and fixed against the inner part of the lid. In the figure the areas 36, 37 the outer part of the lid against the sides 15 and 16 of the container, and thereby provide joinder with the container of the composite lid, which is formed by the inner and the outer parts of the lid.

In FIG. 4 the tear-off strip 34 has been torn and the fixation between the lid and one of the sides of the container has been removed. The remaining part of the flap 32 then forms a handle for lifting of the lid. The lid is still fixed to the container by means of the other flap 33. In this way a hinge-like effect is obtained.

Figure 5B:
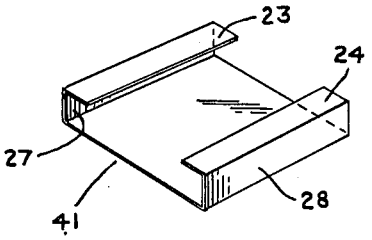

FIG. 5A shows the material for a variation of the inner part of the lid where, as shown in FIG. 5B, there are only two substantially perpendicular sides 27, 28 directed towards the bottom, and therefore also only two edge flanges 23, 24.

Figure 6A:
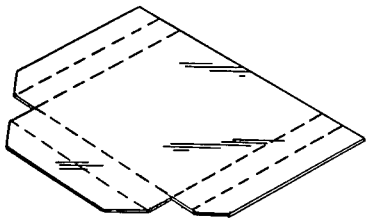
Figure 6B:
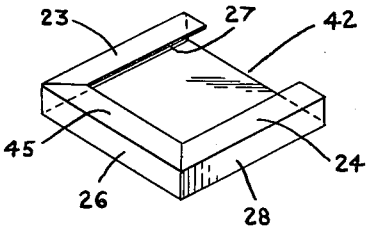

In FIGS. 6A and 6B is shown a variation of the material and the inner part of the lid 42 with three sides 26, 27, and 28 which are substantially at right angles to the bottom of the part of the lid, and with three edge flanges 23, 24, and 45.

Figure 7A:
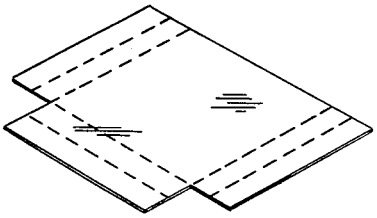
Figure 7B:
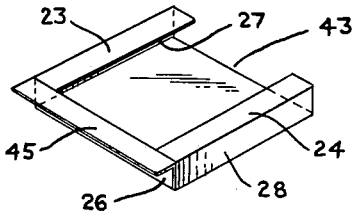
Figure 8A:
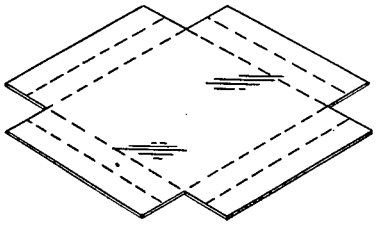
Figure 8B:
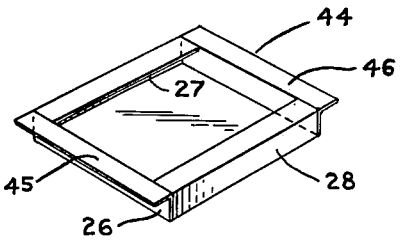

FIGS. 7A and 7B as well as FIGS. 8A and 8B show variations of the inner part of the lid, where one or two of the edge flanges 45, 46 of the part of the lid is/are directed outward from the center of the inner part of the lid.

Figure 9:
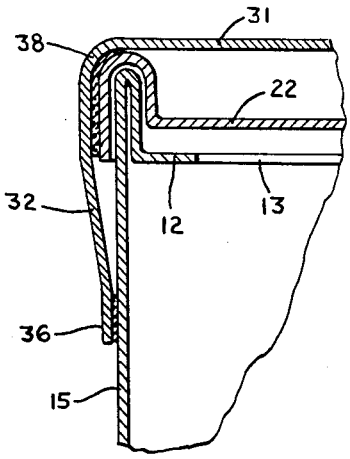
FIGS. 9 and 10 show sections through a closed container.

FIG. 9 shows a detailed section of a closed container with lid in an area where the flap of the outer part of the lid is folded down against the outer surface of the container. As appears from the figure, one of the alternative embodiments according to FIG. 7 or 8 has been used. The flap 45 or 46 of the inner part of the lid is united with the flap 32 or 33 of the outer part of the lid by means of a suitable fixation. For example, through a glue joint. The fixation between the flap of the outer part of the lid and the outside surface of the container by means of a glue joint 36 is also shown.

Figure 10:
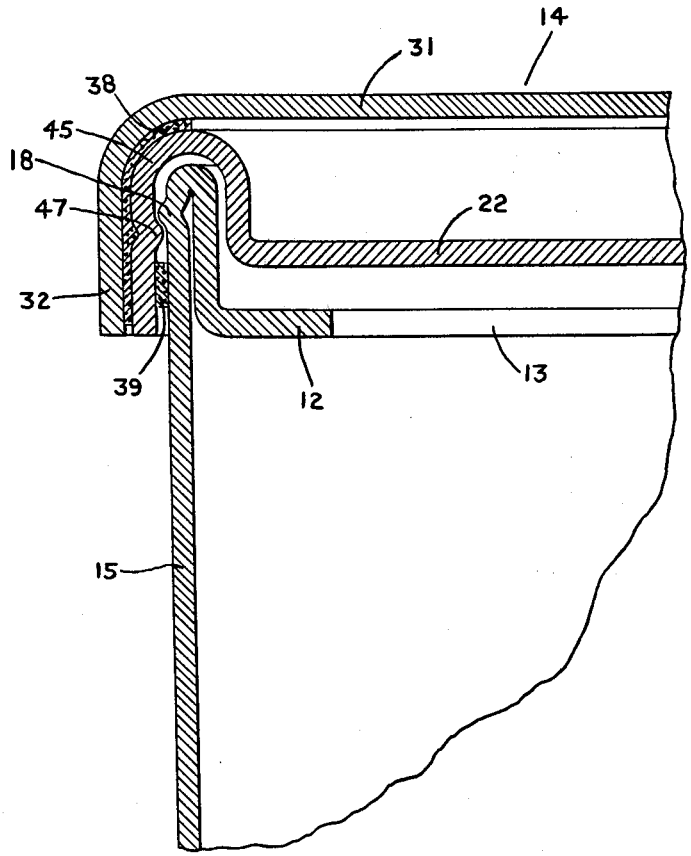

FIG. 10 shows a detailed section of an area corresponding to the one in FIG. 9 but where the lid, at the closing of the container, is fixed against the container, for example, by means of a glue joint 39. The engagement action between the lid and the opening of the container is supplemental in certain examples of application by means of a folding or indentation line 47 arranged on the flap 45 of the inner part of the lid in co-operation with a folding line 18 arranged in the opening part of the container. When the container is closed the folding or indentation line 47 is snapped over the folding line 18. In certain examples of application the fastening of the lid, which is obtained in this way, is sufficiently large to eliminate the fixation by means of the joint 39. Folding lines with snap function by means of folding lines can of course be arranged along several and if necessary along all of the connections of the lid 14 against the outer opening sides of the container. In earlier described embodiments of the invention the alternative with folding lines 18 and 47 can also be adapted.

The flap 32 is shortened in FIG. 10. The opposite flap 33 is alternatively also shortened in a corresponding way. The fixation of the lid against the opening of the container takes place in the same way as described in the above paragraph, also in the area for the flap 33. Alternatively, the flap 33 is arranged in the way described in connection with the FIG. 9.

A container without lid to be used together with a lid in accordance with the invention shall be made according to one of the earlier known procedures.

In order to form the lid, material 20 is folded, which then forms the inner part of the lid 21. The inner part of the lid is placed into the opening of the container, the bottom of the inner part of the lid resting on the peripheral flange 12 of the container or on the limiting surface 13. The material 30 for the outer part of the lid is placed upon the container with the inner part of the lid already in it. The flaps 32, 33 of the material 30 are folded over the edges of the opening and they are pressed by a device against two of the opposite sides 15, 16 of the container. The fixation of the outer part of the lid against the inner part of the lid takes place against the edge flanges 23, 24, 45, 46 of the inner part of the lid. The fixation of the outer part of the lid 31 and thus of the composite lid against the container 10 takes place between the flaps 32, 33 of the outer part of the lid and the two sides 15, 16 of the container. The fixation can take place in a number of alternative ways, for example, by means of glueing, welding, or other similar methods.

The closed container which is formed is opened by removing the tear-off strip 34, and the part of the flap 32 remaining against the lid is used as a handle. In this way the lid can be lifted, which means that the folding line that separates the other flap 33 from the outer part of the lid has a hinge-like function. A container with lid arranged in this way can thus be both opened and reclosed in a very simple way.

From the description and drawings it clearly appears that a container which is arranged with a lid according to the invention will have a very stable opening part, which makes it possible for filled containers to be stacked upon each other. This has been obtained by means of a structure which requires a minimum of material and a very simple technique of manufacture. It is very easy to form the lid of the container in a production plant, for example, for food. Both the container and the lid can be made of a cheap material and by means of substantially the same technique. This makes the production of the package less expensive.

According to a variation of the invention, the outer part of the lid 31 is provided with flaps corresponding to the flaps 32 and 33 along the remaining two edges. These flaps are thus arranged according to one of the alternatives described above. When the flaps are fixed against all sides of the container, flaps with corresponding tear-off strip 34 are arranged in three of the flaps.

What is claimed is:

1. A method of forming an openable closure for a container comprising folding a blank of material to form an inner lid element having a flat bottom and a frame along at least two sides of said bottom, placing said inner lid element into an open end of a filled container with the bottom of the inner lid element facing into the container and the frame releasably bearing against the inner surfaces of the side walls of the container, joining a blank of material for an outer lid element with the frame of the inner lid element and joining the outer lid element to the container with a separable connection to enable separation of the outer lid element from the container together with removal of the entire inner lid element from the container to provide access to the interior of the container.

2. A method as claimed in claim 1 comprising folding at least one flap on the blank of the outer lid element to a position against the outer surface of at least one of the side walls of the container and fixing said flap to said one side wall to provide said separable connection of the outer lid element and the container.

3. A method as claimed in claim 1 wherein said inner lid element is freely and separably contained, in entirety, within said container.

4. A method as claimed in claim 3 wherein said frame of said inner lid element is formed with a U-shaped configuration in cross-section to provide tight engagement with said container when bearing against the inner surfaces of the side walls thereof, the inner lid element being removable from the container, in entirety, by lifting the inner lid element from the container when the outer lid element is separated from the container.

5. A method as claimed in claim 1 wherein the container is formed with a perimetral rim which limits the degree of penetration of the inner lid element into the container.

6. A method as claimed in claim 5 wherein said frame of said inner lid element is wholly contained within the container.

7. A method as claimed in claim 1 wherein said frame of said inner lid element is installed on the container by overlapping one of the walls of the container and being snap-engaged therewith.

8. A method as claimed in claim 7 further comprising adhesively joining the frame of the inner lid element with the outer surface of the wall of the container which it overlaps.

9. A method as claimed in claim 8 wherein the joining of the outer lid element to the inner lid element is effected by adhesively joining said outer lid element to said inner lid element at the location where the inner lid element overlaps the outer surface of the wall of the container.

10. A method as claimed in claim 1 wherein said frame of said inner lid element is installed in the container and overlaps one of the walls of the container, and the outer lid element is joined to the inner lid element adhesively at the location where the inner lid element overlaps the wall of the container.

11. A method as claimed in claim 1 wherein the outer lid element is joined to the inner lid element by adhesives.

12. A method as claimed in claim 11 wherein said outer lid element is hingeably connected to the container such that separation of the outer lid element is effected by pivotably raising the outer lid element, the inner lid element being pivotably raised with said outer lid element.

13. A method as claimed in claim 12 comprising effecting the separable connection of the outer lid element with the container via the inner lid element.

14. A method as claimed in claim 12 comprising effecting reclosure of the container by pivotably lowering the outer lid element, together with the inner lid element, onto the container.

* * * * *